US009001168B2

(12) United States Patent
Nishimura et al.

(10) Patent No.: US 9,001,168 B2
(45) Date of Patent: Apr. 7, 2015

(54) SIGNAL PROCESSING APPARATUS, LIQUID CRYSTAL APPARATUS, ELECTRONICS DEVICE AND SIGNAL PROCESSING METHOD

(71) Applicant: Seiko Epson Corporation, Tokyo (JP)

(72) Inventors: Haruhiko Nishimura, Shiojiri (JP); Junichi Wakabayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 13/790,128

(22) Filed: Mar. 8, 2013

(65) Prior Publication Data

US 2013/0241967 A1 Sep. 19, 2013

(30) Foreign Application Priority Data

Mar. 13, 2012 (JP) ..... 2012-055393

(51) Int. Cl.
*G09G 5/02* (2006.01)
*G09G 3/36* (2006.01)

(52) U.S. Cl.
CPC ..... *G09G 3/3607* (2013.01); *G09G 3/3648* (2013.01); *G09G 2320/0209* (2013.01); *G09G 2340/16* (2013.01); *G09G 2360/18* (2013.01)

(58) Field of Classification Search
None
See application file for complete search history.

(56) References Cited

U.S. PATENT DOCUMENTS

2003/0156121 A1* 8/2003 Willis ..... 345/606
2005/0104833 A1* 5/2005 Ochi et al. ..... 345/96
2007/0273715 A1* 11/2007 Sugiyama ..... 345/690
2008/0018630 A1* 1/2008 Fujino ..... 345/205
2009/0021537 A1* 1/2009 Noguchi et al. ..... 345/690
2009/0073192 A1* 3/2009 Kobayashi ..... 345/643
2009/0109210 A1* 4/2009 Ito ..... 345/214
2009/0243983 A1 10/2009 Ohashi et al.
2010/0007592 A1* 1/2010 Priem et al. ..... 345/89
2011/0051006 A1* 3/2011 Iisaka et al. ..... 348/671
2011/0057961 A1* 3/2011 Tsuru et al. ..... 345/690
2011/0205439 A1* 8/2011 Iisaka et al. ..... 348/607
2011/0205440 A1* 8/2011 Hosaka et al. ..... 348/607
2011/0205479 A1* 8/2011 Hosaka et al. ..... 349/149
2011/0248979 A1* 10/2011 Nishimura ..... 345/211
2012/0242717 A1* 9/2012 Kurosawa ..... 345/690
2013/0241968 A1 9/2013 Wakabayashi et al.

FOREIGN PATENT DOCUMENTS

JP 2009-025417 A 2/2009
JP 2009-104053 A 5/2009
JP 2009-104055 A 5/2009
JP 2009-237366 A 10/2009
JP 2009-237524 A 10/2009
JP 2012-252042 A 12/2012
JP 2012-252206 A 12/2012

* cited by examiner

*Primary Examiner* — Antonio Xavier
(74) *Attorney, Agent, or Firm* — ALG Intellectual Property, LLC

(57) ABSTRACT

In the case where a gray-scale difference Δ1 between a pixel 110*a* and a pixel 110*b*, a gray-scale difference Δ2 between the pixel 110*b* and a pixel 110*c* are each larger than a threshold value, and Δ1>Δ2, gray-scale values of the pixels 110*a*, 110*b* and 110*c* are corrected into the gray-scale value of the pixel 110*b*+Δ1×(1−α), the gray-scale value of the pixel 110*c*+Δ2×(1−α), and the gray-scale value of the pixel 110*c*+Δ2×β, respectively (0≤α, β≤0.5). After the correction, a gray-scale different Δ1a between the pixels 110*a* and 110*b*, and a gray-scale different Δ2a between the pixels 110*b* and 110*c* satisfy the following formulas: Δ1a>Δ1, and Δ2a>Δ2, respectively.

12 Claims, 7 Drawing Sheets

| | | |
|---|---|---|
| (1)130 | (2)130 | (3)130 |
| (4)250 | (5)180 | (6)130 |
| (7)250 | (8)250 | (9)130 |

| | | |
|---|---|---|
| (1)154 | (2)140 | (3)130 |
| (4)215 | (5)155 | (6)140 |
| (7)250 | (8)215 | (9)154 |

SIGNAL PROCESSING APPARATUS, LIQUID CRYSTAL APPARATUS, ELECTRONICS DEVICE AND SIGNAL PROCESSING METHOD

BACKGROUND

1. Technical Field

The present invention relates to a technology for suppressing the occurrence of disclination.

2. Related Art

In a liquid crystal panel, there sometimes occurs a phenomenon, which is called disclination, in which, because of electric-potential between adjacent pixels, there occurs lateral electric field extending in a direction in which adjacent pixel electrodes are arranged, thereby causing liquid crystal molecules to align in a direction different from a desired alignment direction. The occurrence of disclination causes the degradation of a quality of display regarding the liquid crystal panel, and thus, as disclosed in, for example, JP-A-2009-25417, JP-A-2009-104053, JP-A-2009-104055, JP-A-2009-237366 and JP-A-2009-237524, various inventions for suppressing the occurrence of disclination have been made.

Naturally, a correction which is made on display data for one of or both of adjacent pixels between which the lateral electric field strengthens so as to reduces an applied-voltage difference between the adjacent pixels makes it possible to weaken the lateral electric field, thereby, enabling suppression of the occurrence of declination. However, a correction which is made on a certain pixel so as to reduce an electric-field difference with a pixel adjacent to one side of the certain pixel causes an electric-potential difference with another pixel adjacent to the other side of the certain pixel to increase, so that the situation of the occurrence of disclination sometimes becomes worse.

SUMMARY

An advantage of some aspects of the invention is to provide a signal processing apparatus and the like which enables realization of a correction which results in a situation where a post-correction electric-potential difference between any two adjacent pixels is not larger than a pre-correction electric-potential difference therebetween.

According to an aspect of the invention, a signal processing apparatus that is used for a liquid crystal apparatus provided with a plurality of pixels, and that processes a signal for controlling gray-scale for display of each of the plurality of pixels, includes a first detection unit configured to, in the case where a first pixel is arranged between a second pixel and a third pixel, the first pixel, the second pixel and the third pixel being pixels among the plurality of pixels, detect a difference between a first gray-scale value corresponding to the first pixel and a second gray-scale value corresponding to the second pixel as a first gray-scale difference; a second detection unit configured to detect a difference between the first gray-scale value corresponding to the first pixel and a third gray-scale value corresponding to the third pixel as a second gray-scale difference; a comparison unit configured to compare the first gray-scale difference and the second gray-scale difference; and a correction unit configured to make correction of at least two of the first gray-scale value, the second gray-scale value and the third gray-scale value such that the first gray-scale difference is reduced to a third gray-scale difference smaller than the first gray-scale difference and the second gray-scale difference is reduced to a fourth gray-scale difference smaller than the second gray-scale difference, and if the first gray-scale difference is larger than the second gray-scale difference, the correction unit makes the correction such that the third gray-scale difference is larger than the fourth gray-scale difference.

According to this configuration, a post-correction gray-scale difference between any two adjacent pixels is smaller than a pre-correction gray-scale difference therebetween, so that it is possible to make a post-correction electric-potential difference between any two adjacent pixels not larger than a pre-correction electric-potential difference therebetween.

In the aspect of the invention, the comparison unit further performs comparison to determine whether or not each of the first gray-scale difference and the second gray-scale difference is larger than or equal to a threshold value, and the correction unit makes the correction if each of the first gray-scale difference and the second gray-scale difference is larger than or equal to the threshold value.

According to this configuration, the correction is made so as to make a gray-scale difference of any two adjacent pixels smaller than that as of before the correction, and thus, the occurrence of boundaries after the correction can be suppressed.

Further, in the aspect of the invention, in the case where there exists a boundary between the first pixel and the third pixel, the correction unit may be configured to correct input display data for the third pixel.

According to this configuration, in the case where a certain pixel may become a high gray-scale side pixel or a low gray-scale side pixel relative to one of both pixels adjacent to the certain pixel, gray-scale values of the respective both pixels adjacent to the certain pixel are corrected, so that it is possible to suppress shifting of any boundary from its position as of before the correction to its position as of after the correction.

In the aspect of the invention, the comparison unit further compares the first gray-scale value, the second gray-scale value and the third gray-scale value, and the correction unit makes the correction if the first gray-scale value>the second gray-scale value>the third gray scale value, or the first gray-scale value<the second gray-scale value<the third gray scale value.

According to this configuration, for a certain pixel which may become a high gray-scale side pixel or a low gray-scale side pixel relative to one of both pixels adjacent to the certain pixel, the above-described correction of gray-scale values of pixels are made, so that it is possible to suppress shifting of any boundary from its position as of before the correction to its position as of after the correction.

Further, in the aspect of the invention, the correction unit may be configured to make the correction on the basis of the second gray-scale difference.

According to this configuration, it is possible to make a post-correction gray-scale difference between any two adjacent pixels not larger than a pre-correction gray-scale difference therebetween, so that it is possible to suppress shifting of any boundary from its position as of before the correction to its position as of after the correction.

According to another aspect of the invention, a signal processing apparatus that is used for a liquid crystal apparatus provided with a plurality of pixels, and that processes a signal for controlling gray-scale for display of each of the plurality of pixels, includes a first detection unit configured to, in the case where a first pixel is arranged between a second pixel and a third pixel, the first pixel, the second pixel and the third pixel being pixels among the plurality of pixels, if a first difference between a first gray-scale value corresponding to the first pixel and a second gray-scale value corresponding to the second pixel is larger than or equal to a threshold value, detect the first difference as a first gray-scale difference; a second detection unit configured to, if a second difference between the first gray-scale value corresponding to the first pixel and a third gray-scale value corresponding to the third pixel is larger than or equal to the threshold value, detect the second difference as a second gray-scale difference; a comparison unit configured to compare the first gray-scale difference and the second gray-scale difference; and a correction unit configured to make correction of at least two of the first gray-scale value, the second gray-scale value and the third gray-scale value such that the first gray-scale difference is reduced to a third gray-scale difference smaller than the first gray-scale difference and the second gray-scale difference is reduced to a fourth gray-scale difference smaller than the second gray-scale difference, and, if the first gray-scale difference is larger than the second gray-scale difference, the correction unit makes the correction such that the third gray-scale difference is larger than the fourth gray-scale difference.

In addition, according to another aspect of the invention, it is possible to conceive a liquid crystal apparatus, an electronics device and signal processing method, besides the signal processing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
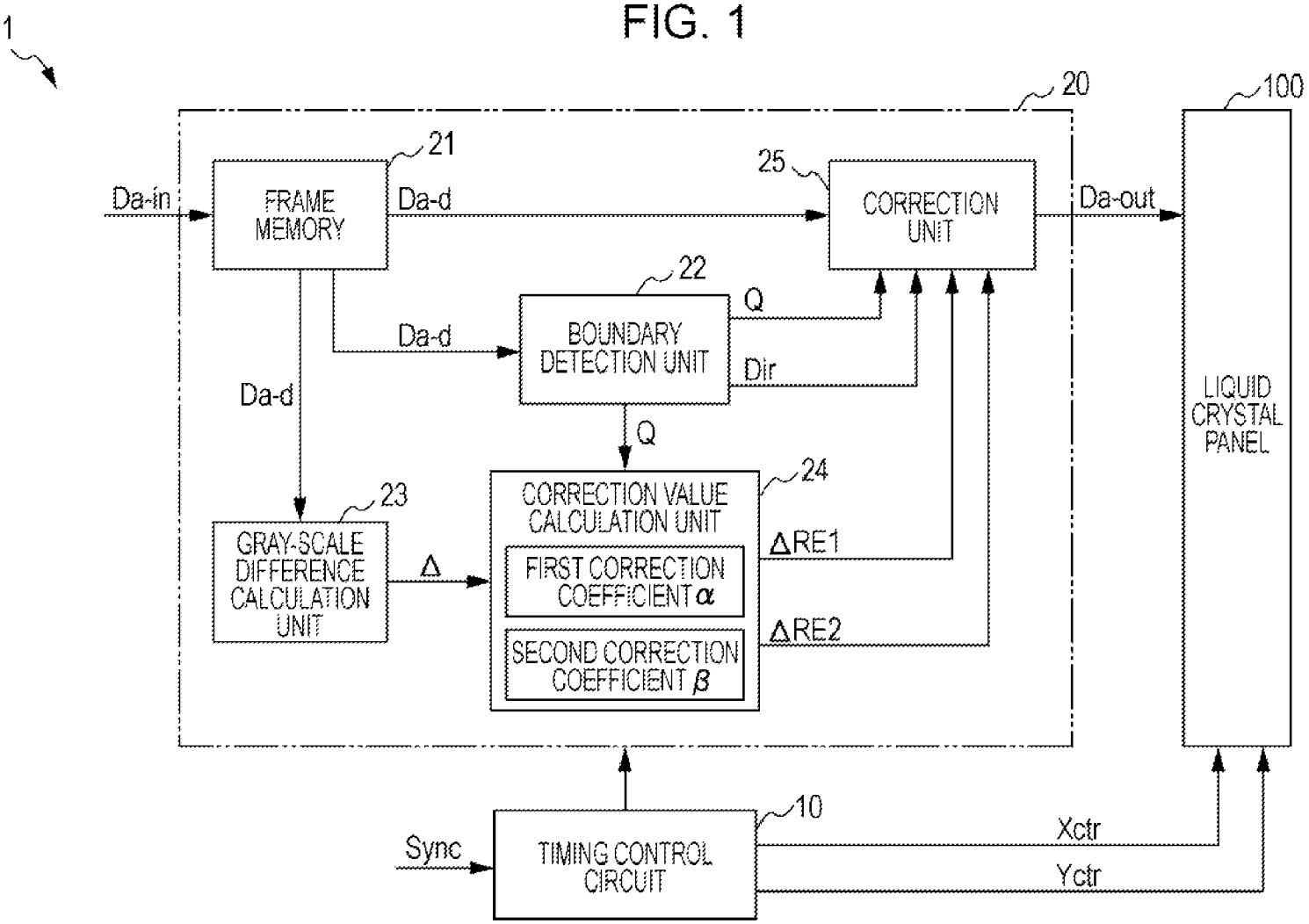
FIG. 1 is a block diagram illustrating a configuration of an electro-optic apparatus according to an embodiment of the invention.

FIG. 1 is a block diagram illustrating the whole configuration of an electro-optic apparatus (an electronics device) 1 according to an embodiment of the invention. As shown in FIG. 1, the configuration of the electro-optic apparatus 1 is roughly divided into a timing control circuit 10, a liquid crystal panel (a liquid crystal apparatus) 100 and an image processing circuit (a signal processing apparatus) 20.

The timing control circuit 10 controls individual portions of the electro-optic apparatus 1 by generating various control signals in synchronization with a synchronization signal Sync which is supplied from an external apparatus (not illustrated).

The image processing circuit 20 is a circuit for control of display performed by the electro-optic apparatus 1. An input display data Da-in is inputted to the image processing circuit 20 from the external apparatus in synchronization with the synchronization signal Sync. The input display data Da-in is pieces of digital data which specify gray-scale values of a respective plurality of pixels (corresponding to a display area 101 described below) included in the liquid crystal panel 100. The gray-scale value is a parameter for specifying the brightness of a pixel. Here, a piece of the input display data Da-in is made a piece of data of eight bits so that a gray-scale value to be represented by a pixel can be specified by one of decimal values varying, by "1", from "0" which corresponds to the darkest state, and "255" which corresponds to the brightest state. The pieces input display data Da-in are supplied in order of scanning in accordance with vertical scanning signals, horizontal scanning signals and dot clock signals (these signals are omitted from illustration), which are included in the synchronization signal Sync. The image processing circuit 20 processes the input display data Da-in, and then outputs display data Da-out to the liquid crystal panel 100.

The liquid crystal panel is, for example, a display apparatus (a display unit) of active matrix type, in which each pixel is driven by a switching element such as a transistor. The liquid crystal panel 100 displays images on the basis of the display data Da-out supplied from the image processing circuit 20. In addition, the input display data Da-in specifies gray-scale values of corresponding pixels (each being a pixel 110 described below) included in the liquid crystal panel 100, while applied voltages applied to liquid crystal elements are determined in accordance with the gray-scale values, respectively, and thus, it can be said that the input display data Da-in specifies applied voltages applied to corresponding liquid crystal element.

Figure 2:
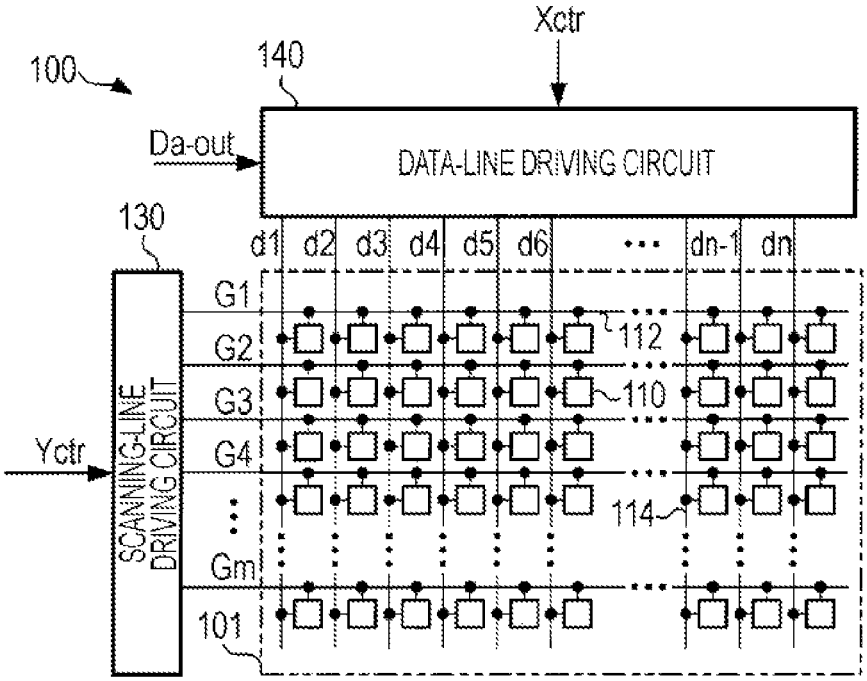
FIG. 2 is a diagram illustrating a configuration of a liquid crystal panel according to an embodiment of the invention.

FIG. 2 is a diagram illustrating a configuration of the liquid crystal panel 100. As shown in FIG. 2, in the display area 101 of the liquid crystal panel 100, where images are displayed, scanning lines 112 consisting of rows 1, 2, 3, . . . , and m are provided so as to extend in a direction (in the horizontal direction in FIG. 2). Further, in the display area 101, data lines 114 consisting of columns 1, 2, 3, . . . , and n are provided so as to extend in a direction perpendicular to the scanning lines 112 (in the vertical direction in FIG. 2). The data lines 114 and the scanning lines 112 are provided so as to be electrically isolated from each other. Further, the pixels 110 are provided so as to correspond to respective intersections of the m rows of scanning lines 112 and the n columns of data lines 114. Accordingly, in this embodiment, the pixels 110 are arranged in the display area 101 in the form of a matrix of m rows in the vertical direction and n columns in the horizontal direction.

The scanning line driving circuit 130 and the data line scanning circuit are located in peripheral areas of the display area 101.

The scanning line driving circuit 130 selects one of the scanning lines 112, which is specified by a selection signal Yctr supplied from the timing control circuit 10. The scanning line driving circuit 130 sets a scanning signal corresponding to the selected scanning line 112 to an H (high) level, which corresponds to a selection voltage, and meanwhile, sets each of scanning signals corresponding to the respective other scanning lines 112 to an L (low) level, which corresponds to a non-selection voltage. In FIG. 2, the scanning signals supplied to the scanning lines 1, 2, 3, . . . , and m are denoted by G1, G2, G3, . . . , and Gm, respectively.

The data line driving circuit 140 is a circuit which drives the pixels 110 by using a so-called voltage modulation method on the basis of the display data Da-out. Specifically, the data line driving circuit 140 supplies the 1st to n-th rows of the data lines 114 with data signals having amounts of voltage corresponding to pieces of display data Da-out, respectively, in accordance with a selection signal Xctr supplied from the timing control circuit 10.

The pixel 110 has a liquid crystal element interposed between a pixel electrode and a common electrode, and while one of the scanning lines 112 is selected, a data signal supplied to one of the data lines 114 is applied to the corresponding pixel electrode.

The driving circuits in the electro-optic apparatus 1 can be realized by cooperation of the scanning line driving circuit 130 and the data line driving circuit 140 which are configured in such a manner as described above.

Figure 3:
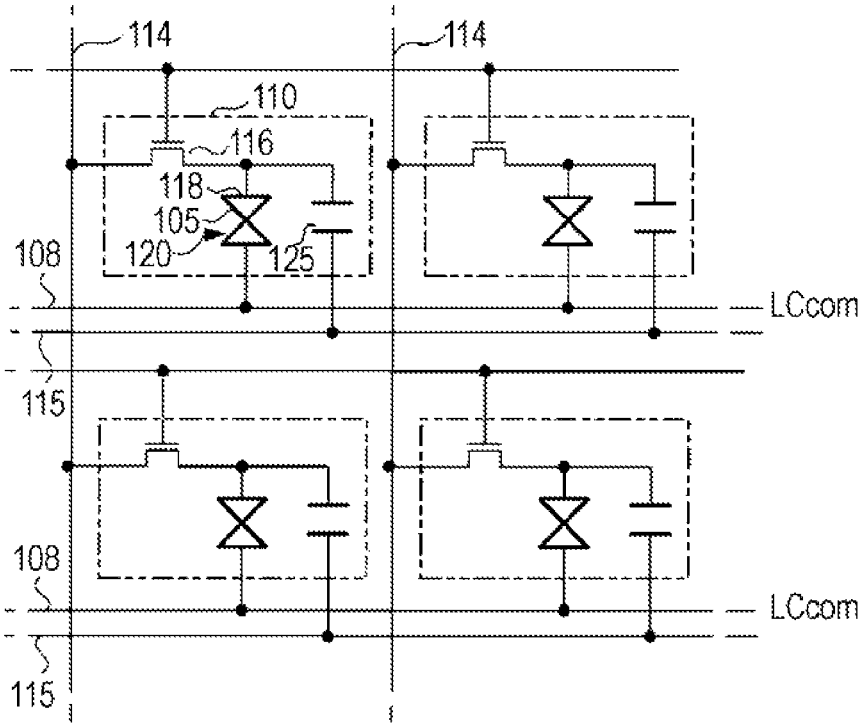
FIG. 3 is diagram illustrating an equivalent circuit of a liquid crystal panel according to an embodiment of the invention.

FIG. 3 is a diagram illustrating an equivalent circuit of the liquid crystal panel 100. As shown in FIG. 3, the liquid crystal panel 100 is configured such that the liquid crystal elements 120, each including liquid crystal 105 interposed between the corresponding pixel electrode 118 and common electrode 108, are aligned so as to correspond to the respective intersections of the scanning lines 112 and the data lines 114. In the equivalent circuit of the liquid crystal panel 100, auxiliary capacitors (storage capacitors) 125 are provided in parallel with the corresponding liquid crystal elements 120. One terminal of any one of the auxiliary capacitors 125 is connected to the corresponding pixel electrode 118, and the other terminal thereof is connected to a capacity line 115 in common with the other terminal of each of the other ones of the auxiliary capacitors 125. In addition, the voltage level of the capacity line 115 is constantly held at a certain voltage level.

Here, when the voltage level of a scanning lines 112 is changed to H level, a thin film transistor (TFT) having a gate electrode connected to the scanning line 112 is turned on, so that a corresponding pixel electrode 118 is connected to a corresponding data line 114. Thus, during a period when the voltage level of the scanning line 112 is H level, when a data signal having a voltage level corresponding to a gray-scale value is supplied to the corresponding data line 114, the data signal is supplied to the corresponding pixel electrode 118 via the TFT 116 which is in the turned-on state. When the voltage level of the scanning line 112 has been changed to L level, the TFT 116 is turned off, but the voltage level of the voltage having been applied to the corresponding pixel electrode 118 is held by the capacitance of the liquid crystal element 120 and the auxiliary capacitor 125.

In the liquid crystal element 120, the molecule alignment state of the liquid crystal 105 changes in accordance with electric field caused by the pixel electrode 118 and the common electrode 108. Thus, in the case of a transmissive type, the liquid crystal element 120 has a transmittance ratio depending on the voltage level of an applied voltage or a hold voltage. In the liquid crystal panel 100, in order to change the transmittance ratios for the respective liquid crystal elements 120, the respective pixels 110 are configured so as to include the liquid crystal elements 120. In addition, in this embodiment, the liquid crystal 105 is configured according to a vertical alignment (VA) method, and is in a normally black mode in which the liquid crystal element 120 is in a black state when no voltage is applied thereto.

Figure 4:
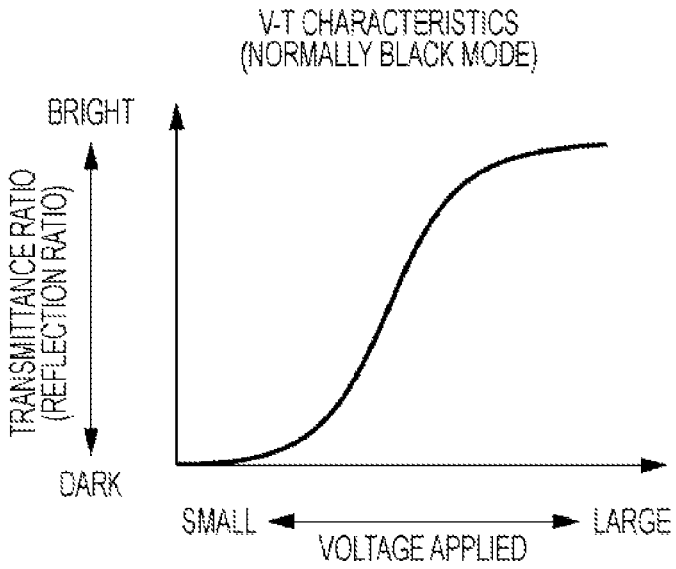
FIG. 4 is a diagram illustrating V-T characteristics in a normally black mode.

FIG. 4 is a graph illustrating a curved line representing relations between applied voltages and transmittance ratios with respect to the liquid crystal element 120 in a normally black mode (hereinafter, the relations will be referred to as "V-T characteristics"). In the graph shown in FIG. 4, the horizontal axis corresponds to the amount of an applied voltage applied to the liquid crystal element 120, and the vertical axis corresponds to the amount of a transmittance ratio (specifically, a relative transmittance ratio) of the liquid crystal element 120. In order to allow the liquid crystal element 120 to have a transmittance ratio corresponding to a certain gray-scale value specified by the display data Da-out, a voltage having an amount of voltage corresponding to the certain gray-scale value should be applied to the liquid crystal element. In the normally black mode, the larger a desired gray-scale value becomes, the larger the amount of voltage to be applied to the liquid crystal element 120 becomes.

In order to prevent degradation of the liquid crystal 105, it is a principle to drive the liquid crystal element 120 by using an alternating-current voltage. In the case where the liquid crystal element 120 is driven by using an alternating-current voltage, when driving the liquid crystal element 120 to allow the liquid crystal element 120 to represent a gray-scale value, the alternating-current voltage needs to have two kinds of voltage polarities, one being a positive voltage polarity having a voltage level higher than a central voltage level of the amplitude of the alternating-current voltage, the other one being a negative voltage polarity having a voltage level lower than the central voltage level of the amplitude of the alternating-current voltage.

In addition, in this embodiment, it is supposed that a voltage except for the applied voltage applied to the liquid crystal element 120 is a voltage relative to ground electric-potential (not illustrated) which is made a reference voltage having a voltage level of zero volt, unless explicitly stated. The applied voltage applied to the liquid crystal element 120 corresponds to an electric-potential difference between a voltage LCcom of the common electrode 108 and the electric-potential of the pixel electrode 118. When causing the liquid crystal element 120 to maintain a voltage having a voltage level corresponding to a gray-scale value, in the case where a writing polarity is a positive polarity, the electric-potential of the pixel electrode 118 is higher than the voltage LCcom of the common electrode 108, and in the case where the writing polarity is a negative polarity, the electric-potential of the pixel electrode 118 is lower than the voltage LCcom of the common electrode 108.

Here, when there exist two adjacent pixels including the liquid crystal elements 120 for which applied voltages have voltage levels which are largely different from each other, the magnitude of lateral electric field becomes larger because of the large difference between the applied voltages, so that disclination sometimes occurs. Among these pixels, a low gray-scale side (low electric-potential side) pixel (a first pixel) may indicate a black state or a substantially black state corresponding to a gray-sale value near a minimum gray-scale value, or may indicate a relatively bright state corresponding to a gray-scale value around an intermediate gray-scale value. Meanwhile, a high gray-scale side (high electric-potential side) pixel (a second pixel) may indicate a state of brightness corresponding to a gray-scale value around an intermediate gray-scale level, or may indicate a white state or a substantially white state corresponding to gray-scale level near a maximum gray-scale value. As described above, disclination occurs because of an electric-potential difference between adjacent pixels, and the magnitudes of brightness around the occurrence areas thereof are various.

Figure 5A:
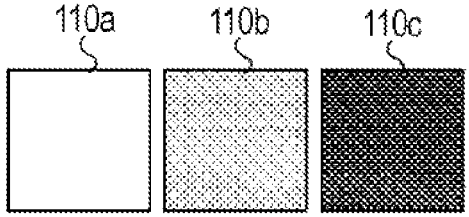
FIGS. 5A and 5B are diagrams illustrating occurrence areas of disclination.
Figure 5B:
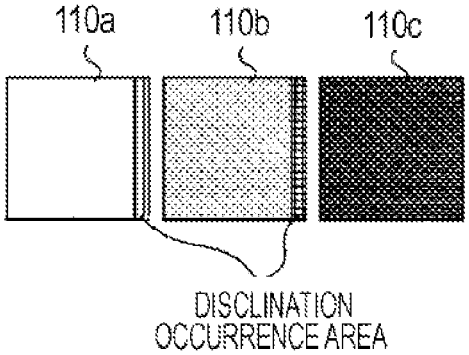

FIGS. 5A and 5B are diagrams illustrating occurrence areas of disclination. In the case where, as shown in FIG. 5A, a pixel 110*a* in a white state (or a substantially white state) is located adjacent to a pixel 110*b* having a color more black than that of the pixel 110*a*, and a pixel 110*c* having a color more black than that of the pixel 110*b* is located adjacent to the pixel 110*b*, the pixels 110*a*, 110*b* and 110*c* should each have a uniform transmittance ratio fundamentally. However, when disclination due to lateral electric field occurs at each of areas which are around a boundary between the pixel 110*a* and the pixel 110*b* and a boundary between the pixel 110*b* and the pixel 110*c*, actually, the display states of the pixels 110*a* to 110*c* become such as shown in FIG. 5B. That is, with respect to an area between the pixel 110*a* and the pixel 110*b*, a partial area, which is included in the high electric-potential side pixel 110*a*, and which is located at the side of the boundary between the pixel 110*a* and the pixel 110*b*, becomes a disclination occurrence area, and with respect to an area between the pixel 110*b* and the pixel 110*c*, a partial area, which is included within the high electric-potential side pixel 110*b*, and which is located at the side of the boundary between the pixel 110*b* and the pixel 110*c*, becomes a disclination occurrence area.

Here, in order to suppress the occurrence of disclination between the pixel 110*a* and the pixel 110*b*, it is necessary to reduce a gray-scale difference (an electric-potential difference) between the pixel 110*a* and the pixel 110*b*, and further, in order to suppress the occurrence of disclination between the pixel 110*b* and the pixel 110*c*, it is necessary to reduce a gray-scale difference (an electric-potential difference) between the pixel 110*b* and the pixel 110*c*. For this reason, in the case where disclination is likely to occur in any one of both pixels adjacent to a pixel, the electro-optic apparatus 1 according to this embodiment causes the image processing circuit 20 to make correction on voltages applied to the pixels such that gray-scale differences with the respective both pixels, not a gray-scale difference with any one of the both pixels, are reduced.

Here, a configuration of the image processing circuit 20 is described with reference to FIG. 1. The image processing circuit 20 includes a frame memory 21, a boundary detection unit 22, a gray-scale difference calculation unit 23, a correction value calculation unit 24 and a correction unit 25.

The frame memory 21 has storage areas corresponding to a pixel array of m rows in the vertical direction and n columns in the horizontal direction, the pixel area corresponding to the display area 101, and stores therein the input display data Da-in whose size is equivalent to that of one segment (one frame). The storage areas store therein pieces of input display data Da-in which specify gray-scale values of the pixels 110 corresponding to the storage areas themselves, respectively. Here, the frame means a period of time necessary to display one segment of image data by driving the liquid crystal panel 100. In the case where the frequency of a vertical scanning signal included in the synchronization signal Sync is 60 Hz, the period of time results in the reciprocal of 60 Hz, that is, 6.7 milliseconds.

In addition, the pieces of input display data Da-in are supplied from an external apparatus, and are written into the corresponding storage areas of the frame memory 21. Further, writing operation of writing the input display data Da-in into the frame memory 21 and reading operation of reading out display data Da-d from the frame memory 21 are performed by, for example, a memory controller (not illustrated) in accordance with driving timing in the liquid crystal panel 100 under the control of the timing control circuit 100. The input display data Da-in and the display data Da-d have substantially the same content of display, but these kinds of data are distinguished from a viewpoint as to whether currently handled data is data to be written into the frame memory 21 or data to be read out from the frame memory 21.

The boundary detection unit 22 analyzes the data Da-d having been read out from the frame memory 21, and thereby, detects boundaries between low gray-scale (low electric-potential) side pixels (second pixels) and high gray-scale (high electric-potential) side pixels (first pixels), the boundaries being ones at each of which a difference between gray-scale values (applied voltage levels), which are specified by the input display data Da-in, is larger than or equal to a threshold value (a boundary detection step). Specifically, the boundary detection unit 22 detects boundaries, at each of which a gray-scale difference value between the first pixel and the second pixel, which are located adjacent to each other, is larger than or equal to a threshold value, on the basis of the display data Da-d. If any boundary satisfying the above condition has been detected, the boundary detection unit 22 sets the value of an output flag Q to "1", and otherwise, the boundary detection unit 22 sets the value of the output flag Q to "0". In addition, pixels adjacent to each pixel are, when viewed from a certain pixel, pixels whose side and one of the sides of the certain pixel are opposite to each other. Thus, four pixels are adjacent to a certain one of the pixels except for pixels located at edge portions of the image display area. Moreover, with respect to a threshold value for a voltage difference (a gray-scale difference) between adjacent pixels, the voltage difference being a condition of the occurrence of discrimination, for example, a value having been calculated on a trial basis is set to the image processing circuit 20.

Further, in the case where the boundary detection unit 22 has detected a plurality of boundaries each satisfying the above condition, the boundary detection unit 22 identifies the location of a boundary for which a gray-scale difference between pixels adjacent to a detected boundary is a minimum one among the gray-scale differences with respect to all the detected boundaries, and the detected location of the boundary relative to a pixel of interest is outputted as a signal Dir.

The gray-scale difference calculation unit 23 calculates a gray-scale difference Δ between gray-scale values of two pixels contacted with each of the boundaries having been detected by the boundary detection unit 22, on the basis of the display data Da-d having been read out from the frame memory 21. Here, the gray-scale difference calculation unit 23 calculates the gray-scale difference Δ by subtracting the gray-scale value of the low gray-scale (low electric-potential) side pixel from the gray-scale value of the high gray-scale (high electric-potential) side pixel. In addition, the gray-scale difference Δ corresponds to an applied voltage difference between pixels. Accordingly, as a result, the larger the gray-scale difference Δ becomes, the larger the applied voltage difference, which is related to the liquid crystal element 120, between pixels.

The correction calculation unit 24 has a memory area for storing therein a first correction coefficient α and a second correction coefficient β, and calculates correction values ΔRE1 and ΔRE2 by causing these corresponding correction coefficients to act on the gray-scale difference Δ having been calculated by the gray-scale difference calculation unit 23. In addition, in this embodiment, the correction coefficients α and β satisfy relations: 0≤First correction efficient α≤0.5 and 0≤Second correction efficient β≤0.5, and here, takes values as follows: α=0.5 and β=0.25. The correction calculation unit 24 calculates the correction value ΔRE1 by multiplying the gray-scale difference Δ, which has been calculated by the gray-scale difference calculation unit 23, by (1−First correction coefficient α). For example, when the gray-scale difference Δ is "40", the correction value ΔRE1 can be calculated as follows: 40×(1−0.5)=20. Further, the correction calculation unit 24 calculates the correction value ΔRE2 by multiplying the gray-scale difference Δ by the second correction coefficient β. For example, when the gray-scale difference Δ is "40", the correction value ΔRE2 can be calculated as follows: 40×0.25=10.

The correction unit 25 performs correction processing on the display data Da-d related to pixels, and outputs the display data Da-out to the liquid crystal panel 100 (a correction step). The correction unit 25 corrects the display data Da-d, provided that the value of the flag Q, which has been outputted from the boundary detection unit 22, is "1" and the following conditions (1) and (2) are satisfied.

(1) Gray-scale value of high gray-scale side pixel−Gray-scale value of low gray-scale side pixel≥Minimum gray-scale difference ΔN (Voltage of high gray-scale side pixel−Voltage of low gray-scale side pixel)≥Minimum voltage difference Δ Vmin)

(2) A boundary exists at the right side of a pixel of interest.

In addition, the minimum gray-scale difference ΔN is a value having been set in advance through a design.

With respect to a high gray-scale side pixel, the correction unit 25 defines a value, which results from subtracting the correction value ΔRE1 from a gray-scale value of the high gray-scale side pixel, as a post-correction gray-scale value. Moreover, with respect to a low gray-scale side pixel, the correction unit 25 defines a value, which results from adding the correction value ΔRE2 to a gray-scale value of the low gray-scale side pixel, as a post-correction gray-scale value.

Figure 6A:
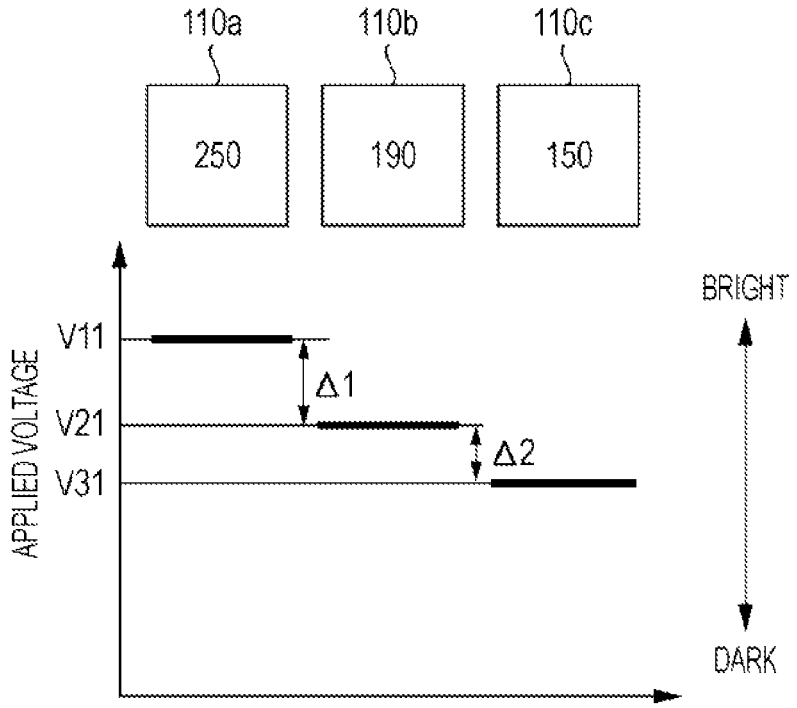
FIGS. 6A and 6B are diagrams each illustrating correction processing according to an embodiment of the invention.
Figure 6B:
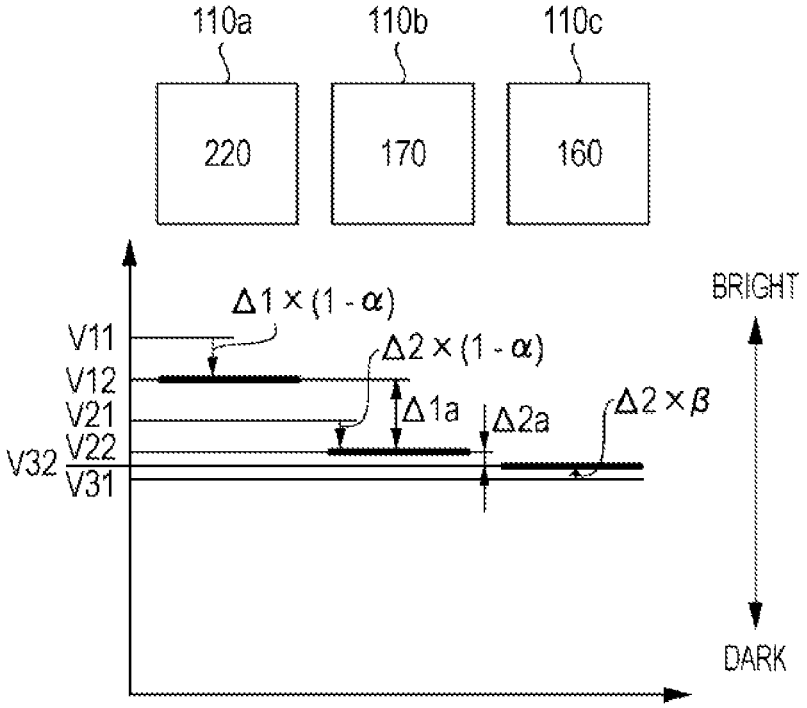
Figure 7A:
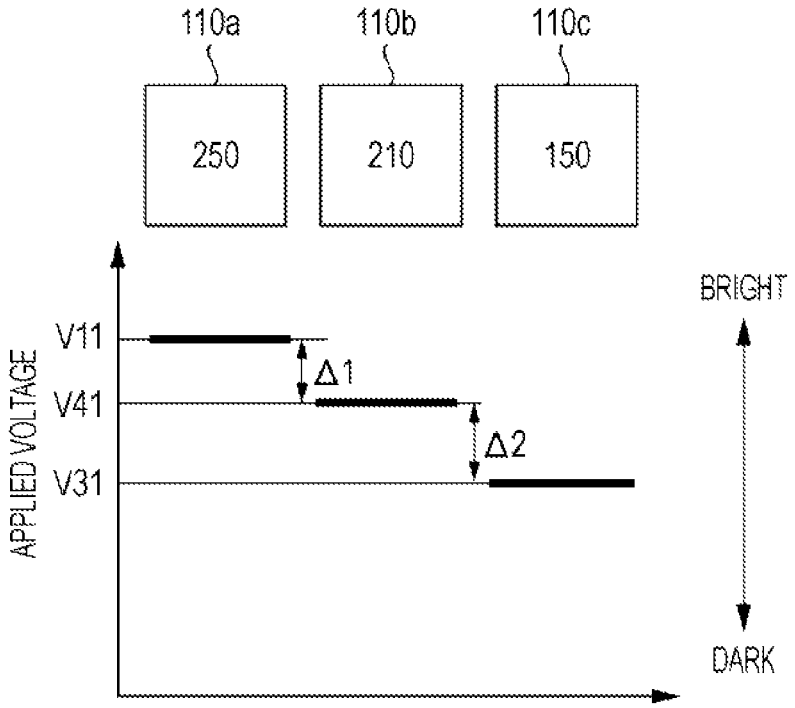
FIGS. 7A and 7B are diagrams each illustrating correction processing according to an embodiment of the invention.
Figure 7B:
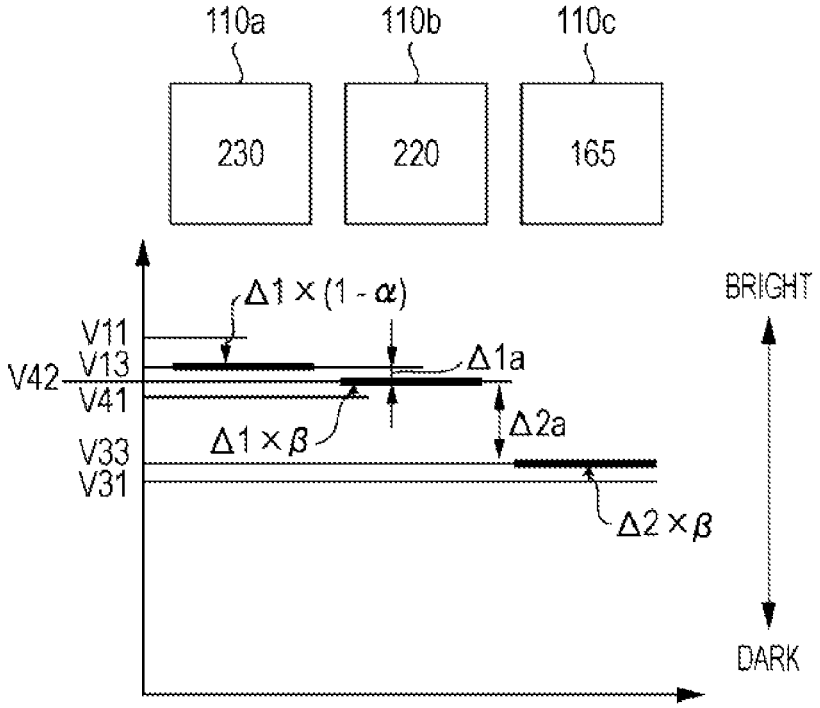

Subsequently, a specific example of correction processing performed by the correction unit 25 will be described. FIGS. 6A, 6B, 7A and 7B are diagrams illustrating specific examples of correction processing. FIGS. 6A, 6B, 7A and 7B are diagrams illustrating correspondence relations between the gray-scale values of pixels 110*a* to pixels 110*c*, which are arranged in the direction in which the scanning lines 112 extend, and the voltage levels of voltages applied to the respective pixels. Further, FIGS. 6A and 7A illustrate pre-correction relations, and FIGS. 6B and 7B illustrate post-correction relations. Further, V11 shown in FIGS. 6A, 6B, 7A and 7B indicates the voltage level of a voltage which is applied to the pixel 110*a* to obtain a pre-correction gray-scale value (250) of the pixel 110*a*, and V31 indicates the voltage level of a voltage which is applied to the pixel 110*c* to obtain a pre-correction gray-scale value (150) of the pixel 110*c*. Further, V21 shown in FIGS. 6A and 6B indicates the voltage level of a voltage which is applied to the pixel 110*b* to obtain a gray-scale value (190) of the pre-correction pixel 110*b*, and V41 shown in FIGS. 7A and 7B indicates the voltage level of a voltage which is applied to the pixel 110*b* to obtain a gray-scale value (210) of the pre-correction pixel 110*b*. Moreover, V12 and V13 each indicate the voltage level of a voltage which is applied to the pixel 110*b* on the basis of a post-correction gray-scale value of the pixel 110*a*. Further, V32 and V33 each indicate the voltage level of a voltage which is applied to the pixel 110*c* on the basis of a post-correction gray-scale value of the pixel 110*c*. Moreover, V22 and V42 each indicate the voltage level of a voltage which is applied to the pixel 110*b* on the basis of a post-correction gray-scale value of the pixel 110*b*.

Further, in FIGS. 6A, 6B, 7A and 7B, the gray-scale value of the pixel 110*a* is larger than that of the pixel 110*b*, and the gray-scale value of the pixel 110*c* is smaller than that of the pixel 110*b*. Further, in FIGS. 6A and 6B, a pre-correction gray-scale difference Δ1 between the pixels 110*a* and 110*b* is larger than a pre-correction gray-scale difference Δ2 between the pixels 110*b* and 110*c*. Further, in FIGS. 7A and 7B, a pre-correction gray-scale difference Δ1 between the pixels 110*a* and 110*b* is smaller than a pre-correction gray-scale difference Δ2 between the pixels 110*b* and 110*c*.

In the case where a pre-correction state is a state shown in FIG. 6A, first, the image processing circuit 20 assigns the pixel 110*a* to a pixel of interest. When the pixel 110*a* has been assigned to a pixel of interest, the display data Da-d corresponding to the pixel 110*a* and a pixel adjacent to the pixel 110*a* is read out from the frame memory 21. The boundary detection unit 22 acquires the gray-scale value (250) specified by the display data Da-d corresponding to the pixel 110*a*, and the gray-scale value (190) specified by the display data Da-d corresponding to the pixel 110*b*.

Here, in the case where the gray-scale difference Δ1 between the high gray-scale side pixel 110*a* (first pixel) and the low gray-scale side pixel 110*b* (second pixel) is larger than or equal to the minimum gray-scale difference ΔN, the boundary detection unit 22 determines that there exists a boundary at which disclination is likely to occur, and outputs the flag Q whose value has been set to "1". Further, the boundary detection unit 22 identifies the location of a boundary at which the gray-scale difference is a minimum one, and a location of this boundary relative to the pixel of interest is outputted as the signal Dir. Here, since the location of the relevant boundary is located at the right side of the pixel of interest, the content of the signal Dir becomes content representing a right side.

Meanwhile, the gray-scale difference calculation unit 23 acquires the gray-scale value (250) specified by the display data Da-d corresponding to the pixel 110*a*, which is a pixel of interest, and the gray-scale value (190) specified by the display data Da-d corresponding to the pixel 110*b*, and calculates the gray-scale difference Δ1 between the both pixels. The ray-scale difference calculation unit 23 outputs the calculated gray-scale difference to the correction value calculation unit 24.

Since the value of the flag Q having been outputted form the boundary detection unit 22 is "1", the correction value calculation unit 24 calculates the correction values ΔRE1 and ΔRE2 on the basis of the gray-scale difference having been obtained from the gray-scale difference calculation unit 23. Here, since the gray-scale difference Δ1 is "60", the correction value ΔRE1 is calculated as follows: 60×(1−0.5)=30, and Correction value ΔRE2 is calculated as follows: 60×0.25=15. The correction value calculation unit 24 outputs the calculated ΔRE1 and ΔRE2 to the correction unit 25.

Next, in the case where the value of flag Q is "1", and the above-described conditions (1) and (2) are satisfied, the correction unit 25 corrects the corresponding display data a-d. In the case where the gray-scale difference Δ1 is larger than or equal to the minimum gray-scale difference ΔN, and the boundary exists at the right side of the pixel of interest, the correction unit 25 corrects the pieces of display data Da-d corresponding to the respective pixels 110*a* and 110*b*.

Here, the content of the signal Dir indicates a right side, and thus, a boundary regarding the pixel of interest, at which the gray-scale difference becomes a minimum one, is located at the right side of the pixel of interest (i.e., at the pixel 110*b* side). In the case where a boundary at which the gray-scale difference becomes a minimum one is located at the right side of the pixel of interest, the correction unit 25 calculates the gray-scale value of a pixel which is located at the high gray-scale side relative to the boundary by using a formula: Gray-scale value of pixel at high gray-scale side−ΔRE1. Here, since the gray-scale value of the high gray-scale side pixel 110*a* is 250, and the ΔRE1 is 30, the post-correction gray-scale value of the pixel 110*a* becomes 220 (a corresponding applied voltage is a V12). Further, the gray-scale value of a pixel which is located at the low gray-scale side relative to the boundary is calculated by using a formula: Gray-scale value of pixel at low gray-scale side+ΔRE2. Here, since the gray-scale value of the low gray-scale side pixel 110*b* is 190, and the ΔRE2 is 15, the gray-scale value of the post-correction pixel 110*b* becomes 205.

Next the image processing circuit assigns the pixel 110*b* to a pixel of interest. In the case where the pixel 110*b* has been assigned to a pixel of interest, display data Da-d corresponding to the pixel 110*b*, which is a pixel of interest, and display data Da-d corresponding to the respective pixels 110*a* and 110*c* which are located adjacent to the pixel 110*b* are read out from the frame memory 21. The boundary detection unit 22 acquires gray-scale values specified by the pieces of display data Da-d corresponding to the respective pixels 110*a* to 110*c*, and determines whether or not at each of the boundaries between the pixels 110*a* and 110*b* and between the pixels 110*b* and 110*c* is a boundary at which disclination is likely to occur. Here, as described above, the boundary between the pixels 110*a* and 110*b* is determined as a boundary at which disclination is likely to occur. Moreover, in the case where, with respect to the boundary between the pixels 110*b* and 110*c*, the gray-scale difference Δ2 is larger than or equal to the minimum gray-scale difference ΔN, the boundary detection unit 22 determines the boundary between the pixels 110*b* and 110*c* as a boundary at which disclination is likely to occur. Since the boundary detection unit 22 has determined that there exists a boundary regarding the pixel of interest, at which disclination is likely to occur, the boundary detection unit 22 outputs the flag Q whose value has been set to "1".

Further, the boundary detection unit 22 identifies the location of a boundary at which a gray-scale difference is a minimum one among the boundaries at each of which disclination is likely to occur, and outputs the location of the relevant boundary relative the pixel of interest as the signal Dir. Here, the gray-scale difference Δ1 between the pixels 110*a* and 110*b* is 60, the gray-scale difference Δ2 between the pixels 110*b* and 110*c* is 40, and the location of the boundary at which the gray-scale difference is a minimum one is located at the right side of the pixel of interest, and thus, the content of the signal Dir becomes content representing a right side.

Meanwhile, the gray-scale difference calculation unit 23 acquires the gray-scale value (190) specified by the display data Da-d corresponding to the pixel 110*b*, and the gray-scale value (150) specified by the display data Da-d corresponding to the pixel 110*c*, and calculates the gray-scale difference (Δ2=40) between the both pixels. The ray-scale difference calculation unit 23 outputs the calculated gray-scale difference to the correction value calculation unit 24.

Since the value of the flag Q having been outputted from the boundary detection unit 22 is "1", the correction value calculation unit 24 calculates the correction values ΔRE1 and ΔRE2 on the basis of the gray-scale difference having been obtained from the gray-scale difference calculation unit 23. Here, the correction values ΔRE1 and ΔRE2 are calculated on the basis of the gray-scale difference between the pixels 110*b* and 110*c*, the correction value ΔRE1 is calculated as follows: 40×(1−0.5)=20, and the correction value ΔRE2 is calculated as follows: 40×0.25=10.

Next, in the case where the value of flag Q is "1", and the above-described conditions (1) and (2) are satisfied, the correction unit 25 corrects the corresponding display data Da-d. In addition, here, the content of the signal Dir indicates a right side, and thus, a boundary regarding the pixel of interest, at which the gray-scale difference becomes a minimum one, is located at the right side of the pixel of interest (i.e., at the pixel 110*c* side).

In the case where a boundary regarding the pixel of interest, at which the gray-scale difference becomes a minimum one, is located at the right side of the pixel of interest, the correction unit 25 calculates the gray-scale value of a pixel which is located at the high gray-scale side relative the boundary by using a formula: Gray-scale value of a pixel at high gray-scale side−ΔRE1. Here, since the gray-scale value of the high gray-scale side pixel 110*b* is 190, and the ΔRE1 is 20, the post-correction gray-scale value of the pixel 110*b* becomes 170 (a corresponding applied voltage is a V22). Further, the gray-scale value of a pixel which is located at the low gray-scale side relative to the boundary is calculated by using a formula: Gray-scale value of a pixel at low gray-scale side+ΔRE2. Here, since the gray-scale value of the low gray-scale side pixel 110*c* is 150, and the ΔRE2 is 10, the gray-scale value of the post-correction pixel 110*c* becomes 160 (a corresponding applied voltage is a V32).

That is, in the case of FIG. 6, with respect to the pixel 110*b* which becomes both a low gray-scale side pixel and a high gray-scale side pixel relative to boundaries, since the gray-scale difference Δ2 is smaller than the gray-scale difference Δ1, the correction is made by using, not the correction value ΔRE2 having been calculated by using the gray-scale difference Δ1, but the correction value ΔRE1 having been calculated by using the gray-scale difference Δ2.

When such a correction has been made, a post-correction gray-scale difference Δ1a between the pixels 110*a* and 110*b* becomes 50. Since the pre-correction gray-scale difference Δ1 was 60, the gray-scale difference becomes smaller than that as of before the correction, that is, the gray-scale difference between the pixels becomes smaller. Further, a gray-scale difference Δ2a between the post-correction pixels 110*b* and 110*c* becomes 10. Since the pre-correction gray-scale difference Δ2 was 40, the gray-scale difference becomes smaller than that as of before the correction, that is, the gray-scale difference between the pixels becomes smaller.

When correcting the gray-scale values (voltage levels) of pixels by means of the aforementioned method according to this embodiment, the correction is made so as to make electric-potential differences between pixels smaller as compared with those as of before the correction, and thus, it is possible to suppress the occurrences of disclination.

Incidentally, in the case where Δ1>Δ2, the post-correction gray-scale difference Δ1a of the gray-scale difference Δ1 is represented as follows: $\Delta 1a=\Delta 1-\Delta 1\times(1-\alpha)+\Delta 2\times(1-\alpha)$. Therefore, the following formula is derived: $\Delta 1-\Delta 1a=\Delta 1\times(1-\alpha)-\Delta 2\times(1-\alpha)=(\Delta 1-\Delta 2)\times(1-\alpha)$. In the case of FIG. 6A, since Δ1>Δ2, the following formula is satisfied: Δ1−Δ1a>0, that is, Δ1a<Δ1. Further, in the case of FIG. 6B, the following formula is satisfied: $\Delta 2a=\Delta 2-\Delta 2\times(1-\alpha)-\Delta 2\times\beta$. Moreover, the above formula is transformed as follows: $\Delta 2-\Delta 2a=\Delta 2\times(1-\alpha)+\Delta 2\times\beta$. Here, α and β are values each being more than or equal to "0", and further, being smaller than or equal to 0.5, and thus, the following formula is satisfied: Δ2−Δ2a>0, that is, Δ2a<Δ2. That is, in the case where Δ1>Δ2, the post-correction gray-scale difference becomes smaller than the pre-correction gray-scale difference.

Here, in the case where β=0, the formulas above are transformed as follows: $\Delta 1a=\Delta 1-\Delta 1\times(1-\alpha)+\Delta 2\times(1-\alpha)=\Delta 1\times\alpha+\Delta 2\times(1-\alpha)$, and $\Delta 2a=\Delta 2-\Delta 2\times(1-\alpha)=\Delta 2\times\alpha$. Since Δ1>Δ2, the following formula is derived: $\Delta 1\times\alpha>\Delta 2\times\alpha$, so that the following formula is concluded: Δ1a>Δ2a. Next, in the case where β is a value other than 0, Δ2a is further smaller by Δ2×β, and thus, the following formula is always satisfied: Δ1a>Δ2a. That is, it follows that even after the correction, with respect to the pixel 110*b*, a relation, in which the gray-scale difference with a pixel located at the left side of the pixel 110*b* is larger than the gray-scale difference with a pixel located at the right side of the pixel 110*b*, is kept.

Next, an example of correction processing in the case where a pre-correction state is shown in FIG. 7A will be described. First, the correction processing circuit assigns the pixel 110*a* to a pixel of interest. When the pixel 110*a* has been assigned to a pixel of interest, display data Da-d corresponding to the pixel 110*a* and pixels adjacent to the pixel 110*a* are read out from the frame memory 21. The boundary detection unit 22 acquires a gray-scale value (250) specified by the display data Da-d corresponding to the pixel 110*a*, and a gray-scale value (210) specified by the display data Da-d corresponding to the pixel 110*b*.

Here, in the case where the gray-scale difference Δ1 between the high gray-scale side pixel 110*a* and the low gray-scale side pixel 110*b* is larger than or equal to the minimum gray-scale difference ΔN, the boundary detection unit 22 determines that there exists a boundary at which disclination is likely to occur, and outputs the flag Q whose value has been set to "1". Further, the boundary detection unit 22 identifies the location of a boundary at which the gray-scale difference is a minimum one, and a location of the relevant boundary relative to the pixel of interest is outputted as the signal Dir. Here, since the location of the relevant boundary is located at the right side of the pixel of interest, the content of the signal Dir becomes content representing a right side.

Meanwhile, the gray-scale difference calculation unit 23 acquires the gray-scale value (250) specified by the display data Da-d corresponding to the pixel 110*a*, and the gray-scale value (210) specified by the display data Da-d corresponding to the pixel 110*b*, and calculates the gray-scale difference Δ (Δ1) between the both pixels. The gray-scale difference calculation unit 23 outputs the calculated gray-scale difference to the correction value calculation unit 24.

Since the value of the flag Q having been outputted form boundary detection unit 22 is "1", the correction value calculation unit 24 calculates the correction values ΔRE1 and ΔRE2 on the basis of the gray-scale difference having been obtained from the gray-scale difference calculation unit 23. Here, since the gray-scale difference Δ1 is "40", the correction value ΔRE1 is calculated as follows: 40×(1−0.5)=20, and the correction value ΔRE2 is calculated as follows: 40×0.25=10. The correction value calculation unit 24 outputs the calculated ΔRE1 and ΔRE2 to the correction unit 25.

Next, in the case where the value of the flag Q is "1", and the above-described conditions (1) and (2) are satisfied, the correction unit 25 corrects the corresponding display data Da-d. In the case where the gray-scale difference Δ1 is larger than or equal to the minimum gray-scale difference ΔN, the correction unit 25 corrects the display data Da-d corresponding to the respective pixels 110*a* and 110*b*.

Here, the content of the signal Dir indicates a right side, and thus, a boundary regarding the pixel of interest, at which the gray-scale difference becomes a minimum one, is located at the right side of the pixel of interest (i.e., at the pixel 110*b* side). In the case where a boundary regarding the pixel of interest, at which the gray-scale difference becomes a minimum one, is located at the right side of the pixel of interest, the correction unit 25 calculates the gray-scale value of a pixel which is located at the high gray-scale side relative to the boundary by using a formula: Gray-scale value of a pixel at high gray-scale side−ΔRE1. Here, since the gray-scale value of the high gray-scale side pixel 110*a* is 250, and the ΔRE1 is 20, the post-correction gray-scale value of the pixel 110*a* becomes 230 (a corresponding applied voltage is a V13). Further, the gray-scale value of a pixel which is located at the low gray-scale side relative to the pixel of interest is calculated by using a formula: Gray-scale value of a pixel at low gray-scale side+ΔRE2. Here, since the gray-scale value of the low gray-scale side pixel 110*b* is 210, and the ΔRE2 is 10, the gray-scale value of the post-correction pixel 110*b* becomes 220.

Next the image processing circuit assigns the pixel 110*b* to a pixel of interest. In the case where the pixel 110*b* has been assigned to a pixel of interest, display data Da-d corresponding to the pixel 110*b*, which is a pixel of interest, and display data Da-d corresponding to the respective pixels 110*a* and 110*c* which are located adjacent to the pixel 110*b* are read out from the frame memory 21. The boundary detection unit 22 acquires gray-scale values specified by the display data Da-d corresponding to the pixels 110*a* to 110*c*, and determines whether or not at each of the boundaries between the pixels 110*a* and 110*b* and between the pixels 110*b* and 110*c* is a boundary at which disclination is likely to occur. Here, as described above, the boundary between the pixels 110*a* and 110*b* is determined as a boundary at which disclination is likely to occur. Moreover, in the case where, with respect to the boundary between the pixels 110*b* and 110*c*, the gray-scale difference Δ2 is larger than or equal to the minimum gray-scale difference ΔN, the boundary detection unit 22 determines the boundary between the pixels 110*b* and 110*c* as a boundary at which disclination is likely to occur. Since the boundary detection unit 22 has determined that there exists a boundary regarding the pixel of interest, at which disclination is likely to occur, the boundary detection unit 22 outputs the flag Q whose value has been set to "1".

Further, the boundary detection unit 22 identifies the location of a boundary at which a gray-scale difference is a minimum one among the boundaries at each of which disclination is likely to occur, and outputs a location of the relevant boundary relative the pixel of interest as the signal Dir. Here, the gray-scale difference Δ1 between the pixels 110*a* and 110*b* is 40, the gray-scale difference Δ2 between the pixels 110*b* and 110*c* is 60, and the location of the boundary at which the gray-scale difference is a minimum one is located at the left side of the pixel of interest, and thus, the content of the signal Dir becomes content representing a left side.

Meanwhile, the gray-scale difference calculation unit 23 acquires the gray-scale value (210) specified by the display data Da-d corresponding to the pixel 110*b*, and the gray-scale value (150) specified by the display data Da-d corresponding to the pixel 110*c*, and calculates the gray-scale difference (Δ2=60) between the both pixels. The ray-scale difference calculation unit 23 outputs the calculated gray-scale difference to the correction value calculation unit 24.

Since the value of the flag Q having been outputted from the boundary detection unit 22 is "1", the correction value calculation unit 24 calculates the correction values ΔRE1 and ΔRE2 on the basis of the gray-scale difference having been obtained from the gray-scale difference calculation unit 23. Here, the correction values ΔRE1 and ΔRE2 are calculated on the basis of the gray-scale difference between the pixels 110*b* and 110*c*, the correction values ΔRE1 is calculated as follows: 60×(1−0.5)=30, and the correction value ΔRE2 is calculated as follows: 60×0.25=15.

Next, in the case where the value of flag Q is "1", and the above-described conditions (1) and (2) are satisfied, the correction unit 25 corrects the corresponding display data Da-d. In addition, here, the content of the signal Dir indicates a left side, and thus, a boundary regarding the pixel of interest, at which the gray-scale difference becomes a minimum one, is located at the left side of the pixel of interest (i.e., at the pixel 110*a* side).

In the case where the boundary regarding the pixel of interest, at which the gray-scale difference becomes a minimum one, is located at the left side of the pixel of interest, the correction unit 25 does not make correction with respect to the pixel 110*b*, which is a pixel of interest, and makes correction with respect to the pixel 110*c*, which is located adjacent to the pixel of interest, by using the correction value ΔRE2. Specifically, the gray-scale value of the pixel 110*b* has become 220 as the result of the above correction, and thus, the gray-scale value of the pixel 110*b* remains 220 as it is (a corresponding applied voltage is a V42). Further, the gray-scale value of the low gray-scale side pixel 110*c* relative to the pixel of interest is 150 and the ΔRE2 is 15, and thus, the post-correction gray-scale value of the pixel 110*c* becomes 165 (a corresponding applied voltage is a V33).

That is, in the case of FIGS. 7A and 7B, with respect to the pixel 110*b* which becomes both a low gray-scale side pixel and a high gray-scale side pixel relative to boundaries, since the gray-scale difference Δ1 is smaller than the gray-scale difference Δ2, the correction is made by using, not the correction value ΔRE2 having been calculated by using the gray-scale difference Δ2, but the correction value ΔRE2 having been calculated by using the gray-scale difference Δ1.

When such a correction has been made, the post-correction gray-scale difference Δ1a between the pixels 110*a* and 110*b* becomes 10. Since the pre-correction gray-scale difference Δ1 was 40, the gray-scale difference becomes smaller than that as of before the correction, that is, the gray-scale difference between the pixels becomes smaller. Further, the post-correction gray-scale difference Δ2a between the pixels 110*b* and 110*c* becomes 55. Since the pre-correction gray-scale difference Δ2 was 60, the gray-scale difference becomes smaller than that as of before the correction, that is, the gray-scale difference between the pixels becomes smaller.

When correcting the gray-scale values (voltage levels) of pixels by means of the aforementioned method according to this embodiment, the correction is made so as to make electric-potential differences between pixels smaller as compared with those as of before the correction, and thus, it is possible to suppress the occurrences of disclination.

Incidentally, in the case where $\Delta 1<\Delta 2$, the post-correction gray-scale difference Δ2a of the gray-scale difference Δ2 is represented as follows: $\Delta 2a=\Delta 2-\Delta 2\times\beta+\Delta 1\times\beta$. Therefore, the following formula is derived: $\Delta 2-\Delta 2a=\Delta 2\times\beta-\Delta 1\times\beta=(\Delta 2-\Delta 1)\times\beta$. In the case of FIG. 7A, the following formula is satisfied: $\Delta 2>\Delta 1$, and as a result, the following formula is satisfied: $\Delta 2-\Delta 2a>0$, that is, $\Delta 2a<\Delta 2$. Further, in the example of FIG. 7B, the following formula is satisfied: $\Delta 1a=\Delta 1-\Delta 1\times(1-\alpha)-\Delta 1\times\beta$. Further, the above formula is transformed as follows: $\Delta 1-\Delta 1a=\Delta 1\times(1-\alpha)+\Delta 1\times\beta$. Here, α and β are values each being more than or equal to "0", and further, being smaller than or equal to 0.5, and thus, the following formula is satisfied: $\Delta 1-\Delta 1a>0$, that is, $\Delta 1a<\Delta 1$. That is, in the case where $\Delta 2>\Delta 1$, the post-correction gray-scale difference also becomes smaller than the pre-correction gray-scale difference.

Here, in the case where $\alpha=0$, the formulas above are transformed as follows: $\Delta 1a=\Delta 1-\Delta 1\times\beta=\Delta 1\times(1-\beta)$, and $\Delta 2a=\Delta 2-\Delta 2\times\beta+\Delta 1\times\beta=\Delta 2\times(1-\beta)+\Delta 1\times\beta$. Since $\Delta 1<\Delta 2$, a formula: $\Delta 2\times(1-\beta)>\Delta 1\times(1-\beta)$ is derived, and the following formula is concluded: $\Delta 2a>\Delta 1a$. Next, in the case where α is a value other than 0, Δ1a is further smaller by $\Delta 1\times(1-\alpha)$, and thus, the following formula is constantly satisfied: $\Delta 2a>\Delta 1a$. That is, it follows that even after the correction, with respect to the pixel 110*b*, a relation, in which the gray-scale difference with a pixel located at the right side of the pixel 110*b* is larger than the gray-scale difference with a pixel located at the left side of pixel 110*b*, is kept.

Electronics Device

Figures 8, 9A, 9B:
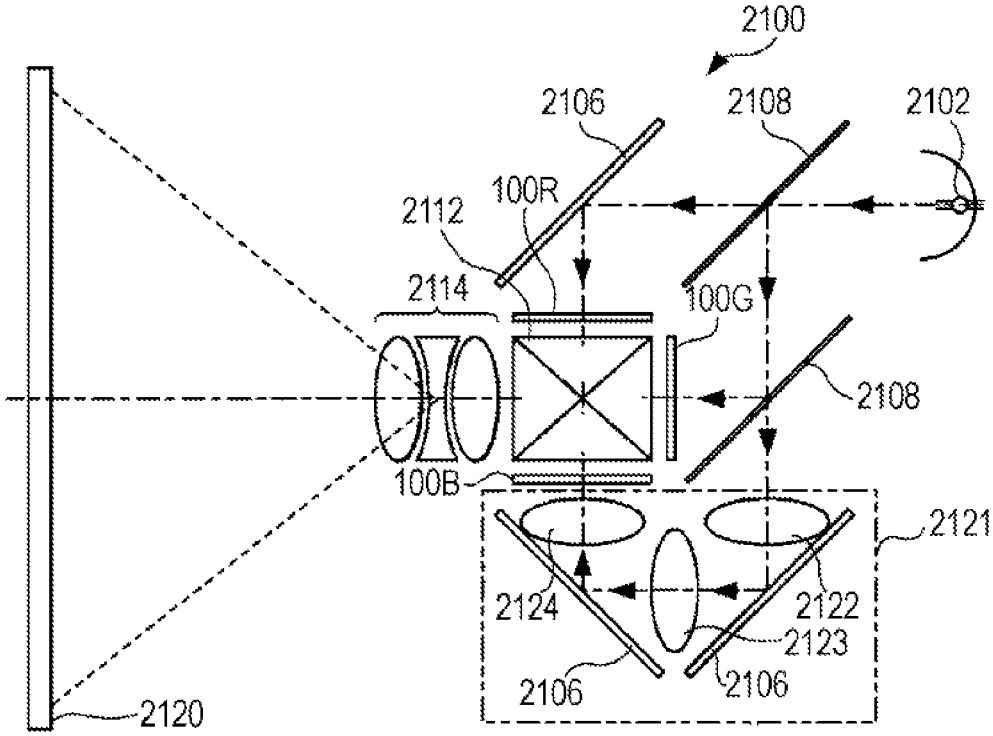
FIG. 8 is a diagram illustrating an example of an electronics device.
FIGS. 9A and 9B are diagrams each illustrating correction processing according to a modification example.

An example of an electronics device employing the electro-optic apparatus 1 will be described. FIG. 8 is a plan view illustrating the configuration of a three-plate type projector employing the liquid crystal panel 100 of the above-described electro-optic apparatus 1. A projector 2100 is provided therein with a lamp unit 2102 including a white light source, such as a halogen lamp. In this projector 2100, light emitting from the lamp unit 2102 is separated into three colored beams of primary colors R (red), G (green) and B (blue) by internally provided tree mirrors 2106 and two dichroic mirrors 2108, and the three colored beams are conducted to light valves 100R, 100G and 100B corresponding to the three primary colors, respectively. In addition, the B-colored beam has a longer light path, as compared with the R-colored beam and the G-colored beam, and thus, in order to prevent a loss due to the long light path, the B-colored light beam is conducted via a relay lens system including a light-incoming lens 2122, a relay lens 2123 and a light-outgoing lens 2124.

Here, the configuration of the light valves 100R, 100G and 100B is similar to that of the liquid crystal panel 100 in the aforementioned embodiment, and the light valves are driven by data Da-out which is supplied from an external apparatus (not illustrated), and which corresponds to individual R, G and B colors. Light beams having been modulated by the respective light valves 100R, 100G and 100B are inputted to a dichroic prism 2112 from three directions. Further, in this dichroic prism 2112, the R-colored light beam and the B-colored light beam are each refracted at an angle of 90 degrees; while the G-colored light beam goes straight. Moreover, an image resulting from synthesizing individual colored images is subjected to normal rotation and extended projection, and finally, a color image is displayed on a screen 2120.

Images transmitting through the light valves 100R and 100B are projected after having been reflected by the dichroic prism 2112; while an image transmitting through the light valve 100G is projected as it is, and thus, there is a mirror reversed relation between an image formed by the light valves 100R and 100B, and an image formed by the light valve 100G.

In addition, well-known examples of an electronics device includes, besides the projector, a rear-projection type television device, a direct-view type television device, a mobile telephone, a personal computer, a video camera monitor, a car navigation device, a pager, an electronics diary, an electronic calculator, a word processer, a work station, a video telephone, a point of sales (POS) terminal, a digital still camera, a device with a touch panel, and the like. Further, the electro-optic apparatus according to some aspects of the invention can be also applied to such various types of electronics devices.

Modification Example

Hereinbefore, an embodiment according to the invention has been described, but the invention is not limited to the embodiment described above, and can be practiced in various forms. For example, the above-described embodiment may be transformed as described below, and there, the invention may be practiced. In addition, the above-described embodiment and the following individual modification examples may be appropriately combined.

In the embodiment described above, the liquid crystal panel 100 is a normally black panel, but, may be a normally white panel. In the case of a normally white display panel, a relation between the voltage applied to the liquid crystal element 120 and the gray-scale value regarding the liquid crystal element 120 is inverse to that in the case of a normally black panel, and the smaller the gray-scale value regarding the liquid crystal element 120 becomes, the larger the voltage level of the voltage applied to the liquid crystal element 120.

In the above-described embodiment, in the case where the gray-scale difference Δ1 between a pixel of interest and the pixel located at the left side of the pixel of interest is equal to the gray-scale difference Δ2 between the pixel of interest and the pixel located at the right side of the pixel of interest, correction processing may be performed in a way similar to that in the case where the gray-scale difference Δ2>the gray-scale difference Δ1.

In the above-described embodiment, the gray-scale value of a pixel of interest and the gray-scale values of pixels which are located adjacent to the pixel of interest in the direction in which the scanning lines 112 extend are corrected on the basis of gray-scale differences between the pixel of interest and the pixels which are located adjacent to the pixel of interest in the direction in which the scanning lines 112 extend, but pixels targeted for correction are not limited to such pixels, and, for example, the gray-scale values of pixels which are located adjacent to a pixel of interest in the direction in which the data lines 114 extend may be corrected. Moreover, the correction processing on the gray-scale values of pixels which are located adjacent to a pixel of interest in the direction in which the scanning lines 112 extend and the correction processing on the gray-scale values of pixels which are located adjacent to a pixel of interest in the direction in which the data lines 114 extend may be appropriately combined.

For example, in the case where α=0.5 and β=0.2, the gray-scale values of pixels are such as shown in FIG. 9A, and a pixel denoted by (1) is assigned to a pixel of interest, the gray-scale values are corrected by calculating a gray-scale value difference between the pixel denoted by (1) and a pixel denoted by (2), and a gray-scale value difference between the pixel denoted by (1) and a pixel denoted by (4). Here, since the gray-scale values of the pixel denoted by (1) and the pixel denoted by (2) are the same with each other, correction is made on the basis of a gray-scale difference between the pixel denoted by (1) and the pixel denoted by (4) in the case where the gray-scale value difference between the pixel denoted by (1) and the pixel denoted by (4) is larger than or equal to the minimum gray-scale difference ΔN. Specifically, since the gray-scale difference Δ=250−130=120, the calculation result is such that ΔRE1=60 and ΔRE2=24. Since a post-correction gray-scale value of the pixel denoted by (1), which is a low gray-scale side pixel, is calculated as follows: Gray-scale value of pixel denoted by (1)+ΔRE2, a post-correction gray-scale value of pixel denoted by (1) results in as follows: 130+24=154.

Further, in the case where the pixel denoted by (4) is assigned to a pixel of interest, a gray-scale difference between the pixel denoted by (4) and the pixel denoted by (1) is 120, and a gray-scale difference between the pixel denoted by (4) and a pixel denoted by (5) is 70. Thus, the ΔRE1 is calculated as follows: 70×(1−0.5)=35, and a post-correction gray-scale value of the pixel denoted by (4), which is a high gray-scale side pixel, is calculated by using an expression: Gray-scale value of pixel denoted by (4)−ΔRE1, and results in 215.

Moreover, in the case where a pixel denoted by (5) is assigned to a pixel of interest, a gray-scale difference between the pixel denoted by (5) and the pixel denoted by (2) is 50, and a gray-scale difference between the pixel denoted by (5) and a pixel denoted by (8) is 70. Thus, the ΔRE1 is calculated as follows: 50×(1−0.5)=25, and the ΔRE2 is calculated as follows: 50×0.2=10. A post-correction gray-scale value of the pixel denoted by (5), which is a high gray-scale side pixel, results in as follows: Gray-scale value of pixel denoted by (5)−ΔRE1=155, and a post-correction gray-scale value of the pixel denoted by (6), which is a low gray-scale side pixel, results in as follows: Gray-scale value of pixel denoted by (6)+ΔRE2=140.

In the above-described embodiment, the gray-scale values of a pixel of interest and a pixel located adjacent to the right side of the pixel of interest are corrected, but, for example, in the case where the viewable direction of liquid crystal is reverse to the direction thereof in the above-described embodiment, the gray-scale values of a pixel of interest and a pixel located adjacent to the left side of the pixel of interest may be corrected.

Figure 10A:
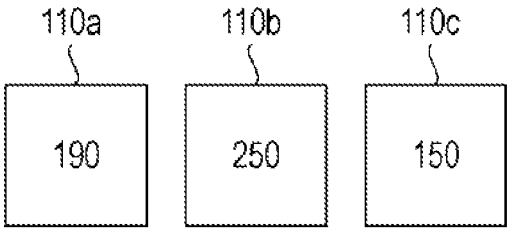
FIGS. 10A and 10B are diagrams each illustrating correction processing according to a modification example.
Figure 10B:
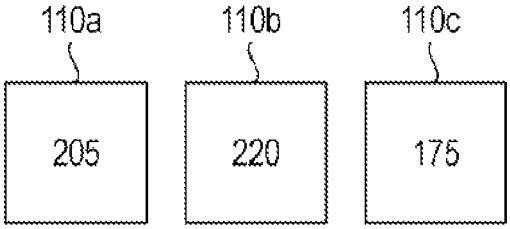

Although the foregoing description of operation is made under the condition that the gray-scale value of the pixel 110*a*>the gray-scale value of the pixel 110*b*>the gray-scale value of the pixel 110*c*, any condition under which the correction is made is not limited to this condition. For example, the gray-scale values of the respective pixels 110*a* to 110*c* may be corrected even in the case where, as shown in FIG. 10A, relations between the pre-correction gray-scale values of the pixels 110*a* to 110*c* are such that the gray-scale value of the pixel 110*b*>the gray-scale value of the pixel 110*a*>the gray-scale value of the pixel 110*c*, and a gray-scale difference between the pixel 110*a* and the pixel 110*b* is smaller than a gray-scale value difference between the pixel 110*b* and the pixel 110*c*. In this case, the post-correction gray-scale values of the respective pixels are such as shown in FIG. 10B. Here, even after the correction, relations between the gray-scale values of the pixels become such that the gray-scale value of the pixel 110*b*>the gray-scale value of the pixel 110*a*>the gray-scale value of the pixel 110*c*, and thus, the relation in which a gray-scale difference between the pixel 110*a* and the pixel 110*b* is smaller than a gray-scale difference between the pixel 110*b* and the pixel 110*c* is kept.

Figure 11A:
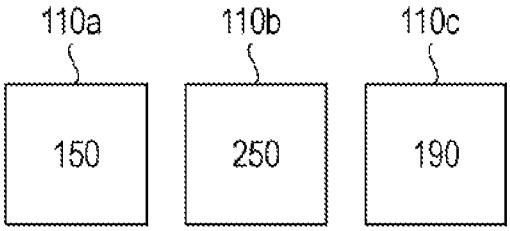
FIGS. 11A and 11B are diagrams each illustrating correction processing according to a modification example.
Figure 11B:
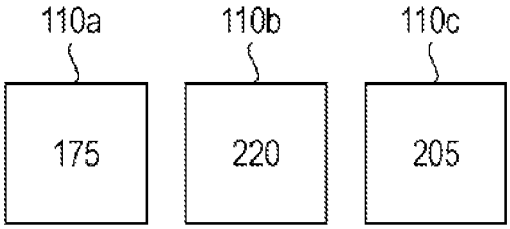

Moreover, the gray-scale values of the respective pixels 110*a* to 110*c* may be also corrected even in the case where, as shown in FIG. 11A, relations between the pre-correction gray-scale values of the pixels 110*a* to 110*c* are such that the gray-scale value of the pixel 110*b*>the gray-scale value of the pixel 110*c*>the gray-scale value of the pixel 110*a*, and a gray-scale difference between the pixel 110*b* and the pixel 110*c* is smaller than a gray-scale difference between the pixel 110*a* and the pixel 110*b*. In this case, the post-correction gray-scale values of the respective pixels are such as shown in FIG. 11B. Here, even after the correction, relations between the gray-scale values of the pixels become such that the gray-scale value of the pixel 110*b*>the gray-scale value of the pixel 110*c*>the gray-scale value of the pixel 110*a*, the relation in which a gray-scale difference between the pixel 110*b* and the pixel 110*c* is smaller than a gray-scale difference between the pixel 110*a* and the pixel 110*b* is kept.

Furthermore, the gray-scale values of the respective pixels 110*a* to 110*c* may be corrected even in the case where relations between the pre-correction gray-scale values of the pixels 110*a* to 110*c* are such that the gray-scale value of the pixel 110*a*<the gray-scale value of the pixel 110*b*<the gray-scale value of the pixel 110*c*.

This application claims priority to Japan Patent Application No. 2012-055393 filed Mar. 13, 2012, the entire disclosures of which are hereby incorporated by reference in their entireties.

What is claimed is:

1. A signal processing apparatus that is used for a liquid crystal apparatus provided with a plurality of pixels, and that processes a signal for controlling gray-scale for display of each of the plurality of pixels, the signal processing apparatus comprising:

a first detection unit configured to, in the case where a first pixel is arranged between a second pixel and a third pixel, the first pixel, the second pixel and the third pixel being pixels among the plurality of pixels, detect a difference between a first gray-scale value corresponding to the first pixel and a second gray-scale value corresponding to the second pixel as a first gray-scale difference;

a second detection unit configured to detect a difference between the first gray-scale value corresponding to the first pixel and a third gray-scale value corresponding to the third pixel as a second gray-scale difference;

a comparison unit configured to compare the first gray-scale difference and the second gray-scale difference; and a correction unit configured to make correction of at least two of the first gray-scale value, the second gray-scale value and the third gray-scale value such that the first gray-scale difference is reduced to a third gray-scale difference smaller than the first gray-scale difference and the second gray-scale difference is reduced to a fourth gray-scale difference smaller than the second gray-scale difference, and such that the third gray-scale difference is larger than the fourth gray-scale difference when the first gray-scale difference is larger than the second gray-scale difference, and the third gray-scale difference is smaller than the fourth gray-scale difference when the first gray-scale difference is smaller than the second gray-scale difference.

2. The signal processing apparatus of claim 1, wherein the comparison unit performs comparison to determine whether or not each of the first gray-scale difference and the second gray-scale difference is larger than or equal to a threshold value, and the correction unit makes the correction if each of the first gray-scale difference and the second gray-scale difference is larger than or equal to the threshold value.

3. The signal processing apparatus of claim 1, wherein the comparison unit further compares the first gray-scale value, the second gray-scale value and the third gray-scale value, and the correction unit makes the correction if the first gray-scale value>the second gray-scale value>the third gray scale value, or the first gray-scale value<the second gray-scale value<the third gray scale value.

4. The signal processing apparatus of claim 1, wherein the comparison unit makes the correction on the basis of the second gray-scale difference.

5. An electronic device comprising the signal processing apparatus of claim 4.

6. A liquid crystal apparatus comprising the signal processing apparatus of claim 1.

7. A signal processing apparatus that is used for a liquid crystal apparatus provided with a plurality of pixels, and that processes a signal for controlling gray-scale for display of each of the plurality of pixels, the signal processing apparatus comprising:

a first detection unit configured to, in the case where a first pixel is arranged between a second pixel and a third pixel, the first pixel, the second pixel and the third pixel being pixels among the plurality of pixels, and a first difference between a first gray-scale value corresponding to the first pixel and a second gray-scale value corresponding to the second pixel is larger than or equal to a threshold value, detect the first difference as a first gray-scale difference;

a second detection unit configured to, when a second difference between the first gray-scale value corresponding to the first pixel and a third gray-scale value corresponding to the third pixel is larger than or equal to the threshold value, detect the second difference as a second gray-scale difference;

a comparison unit configured to compare the first gray-scale difference and the second gray-scale difference; and a correction unit configured to make correction of at least two of the first gray-scale value, the second gray-scale value and the third gray-scale value such that the first gray-scale difference is reduced to a third gray-scale difference smaller than the first gray-scale difference and the second gray-scale difference is reduced to a fourth gray-scale difference smaller than the second gray-scale difference, and such that the third gray-scale difference is larger than the fourth gray-scale difference when the first gray-scale difference is larger than the second gray-scale difference, and the third gray-scale difference is smaller than the fourth gray-scale difference when the first gray-scale difference is smaller than the second gray-scale difference.

8. The signal processing apparatus of claim 7, wherein the comparison unit further compares first gray-scale value, the second gray-scale value and the third gray-scale value, and the correction unit makes the correction if the first gray-scale value>the second gray-scale value>the third gray scale value, or the first gray-scale value<the second gray-scale value<the third gray scale value.

9. The signal processing apparatus of claim 7, wherein the comparison unit makes the correction on the basis of the second gray-scale difference.

10. A liquid crystal apparatus comprising the signal processing apparatus of claim 7.

11. An electronics device comprising the signal processing apparatus of claim 7.

12. A signal processing method that is used for a liquid crystal apparatus provided with a plurality of pixels, and that processes a signal for controlling gray-scale for display of at each of the plurality of pixels, the signal processing method comprising:

in the case where a first pixel is arranged between a second pixel and a third pixel, the first pixel, the second pixel and the third pixel being pixels among the plurality of pixels, and a first difference between a first gray-scale value corresponding to the first pixel and a second gray-scale value corresponding to the second pixel is larger than or equal to a threshold value, detecting the first difference as a first gray-scale difference;

when a second difference between the first gray-scale value corresponding to the first pixel and a third gray-scale value corresponding to the third pixel is larger than or equal to the threshold value, detecting the second difference as a second gray-scale difference;

comparing the first gray-scale difference and the second gray-scale difference; and correcting at least two of the first gray-scale value, the second gray-scale value and the third gray-scale value such that the first gray-scale difference is reduced to a third gray-scale difference smaller than the first gray-scale difference and the second gray-scale difference is reduced to a fourth gray-scale difference smaller than the second gray-scale difference, and such that the third gray-scale difference is larger than the fourth gray-scale difference when the first gray-scale difference is larger than the second gray-scale difference, and the third gray-scale difference is smaller than the fourth gray-scale difference when the first gray-scale difference is smaller than the second gray-scale difference.

* * * * *